United States Patent [19]

Busch et al.

[11] Patent Number: 4,604,958

[45] Date of Patent: Aug. 12, 1986

[54] FEED DRIVE FOR THE WORK HOLDER OF A ZIG-ZAG SEWING MACHINE

[75] Inventors: Edgar Busch, Trippstadt; Ernst Albrecht, Hochspeyer, both of Fed. Rep. of Germany

[73] Assignee: Pfaff Industriemaschinen GmbH, Fed. Rep. of Germany

[21] Appl. No.: 763,535

[22] Filed: Aug. 7, 1985

[30] Foreign Application Priority Data

Aug. 16, 1984 [DE] Fed. Rep. of Germany ... 8424175[U]

[51] Int. Cl.[4] ..... D05B 3/00; D05B 27/00

[52] U.S. Cl. ..... 112/443; 112/121.15; 112/304; 112/311

[58] Field of Search ..... 112/304, 446, 448, 449, 112/121.12, 121.15, 90, 119, 459, 462, 464, 157, 311, 443

[56] References Cited

U.S. PATENT DOCUMENTS 3,358,626 12/1967 Bryan ..... 112/121.12
4,088,085 5/1978 Hager ..... 112/121.15 X
4,474,123 10/1984 Ponte ..... 112/157 X

FOREIGN PATENT DOCUMENTS 1092284 4/1961 Fed. Rep. of Germany .
2925253 1/1983 Fed. Rep. of Germany .

*Primary Examiner*—Werner H. Schroeder
*Assistant Examiner*—Andrew M. Falik
*Attorney, Agent, or Firm*—McGlew and Tuttle

[57] ABSTRACT

A feed drive for the work holder of a zig-zag stitch group sewing machine comprises a rotatable cam plate and a work holder which is engaged with the plate and moved thereby within a rectilinear guide arranged adjacent the head portion of the sewing machine. The work holder is located adjacent the needle and it includes a driver plate which extends below the sewing machine arm portion and grips the workpiece from above. The cam plate is arranged in a standard of the machine and the work holder is driven by engagement of a sensing element in a groove of the cam plate which is connected to the work holder through a lever drive acting on a rotatable shaft arranged below the arm of the machine and connected with a crank and a link with a slide carrying the work holder which is disposed in a guide. The construction includes a seating for the workpiece which is movable parallel to the guide and is coupled with the driving plate. This comprises two endless belts which are disposed on freely rotatable guide rollers and which have a spacing corresponding to the maximum swinging amplitude of the needle.

5 Claims, 6 Drawing Figures

Fig. 4
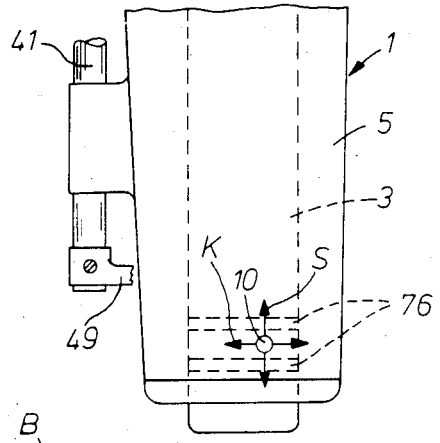
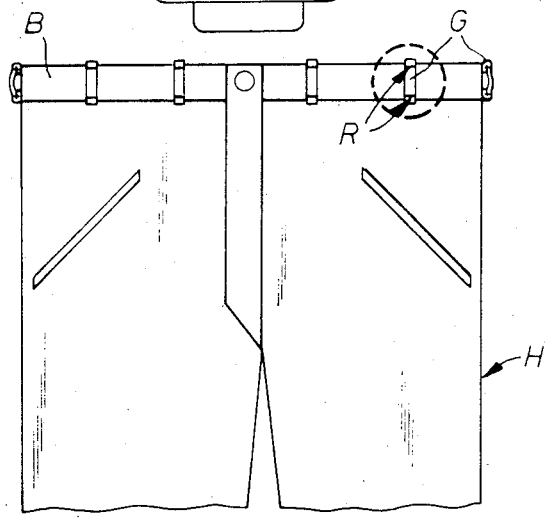
Fig. 5
Fig. 6
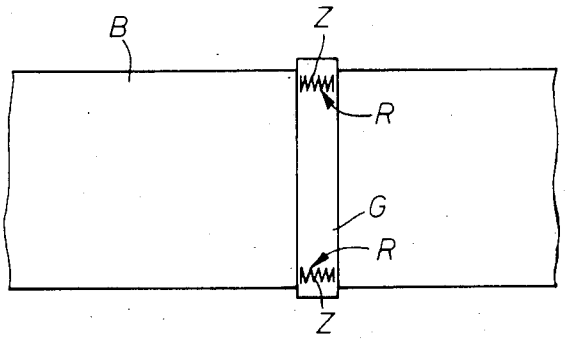

FEED DRIVE FOR THE WORK HOLDER OF A ZIG-ZAG SEWING MACHINE

FIELD AND BACKGROUND OF THE INVENTION

This invention relates in general to sewing machines and in particular to a new and useful feed drive for the work holder of a zig-zag stitch group sewing machine.

The innovation relates particularly to a zig-zag stitch group sewing machine which contains a work holder movable by a cam plate parallel to the longitudinal direction of the housing arm and a needle bar moving up and down which executes lateral swinging movements controlled by the same cam plate, these swinging movements occurring crosswise to the longitudinal direction of the housing arm. The advantage of this movement direction of the work holder and of the needle bar common in buttonhole sewing machines generally is that their movement paths are straight. Also it is advantageous that the drive elements arranged between the work holder and the cam plate move essentially in a common plane, so that no moments occur between the work holder and its drive. With this type of machine, however, technical difficulties of handling exist if the zig-zag stitches to be executed by the needle bar extend crosswise to the longitudinal edge of the work. In this case, in fact, the longitudinal edge of the work runs parallel to the longitudinal direction of the housing arm, so that in particular for long pieces of material it may be difficult to handle the part of the work present under the housing arm. Also, it is not possible with such machines to to form transverse zig-zag bars, e.g. the fastening bars of belt loops, on tubular material.

U.S. Pat. No. 4,171,673 (German Pat. No. 29 25 253) teaches a stitch group sewing machine where, for the formation of relatively large seam patterns, the work holder is moved in longitudinal and transverse directions. The work holder is arranged at the end of a telescoping arm pivotably mounted in the region of the housing standard and is moved lengthwise and crosswise to the telescoping arm through two rope pulley drives driven by step motors. Connected with the two rope pulley drives is a compensating device which in case of a pure swinging movement of the telescoping arm transforms the arcuate path of the work holder into a rectilinear one.

Rectilinear guides for a work holder are known in themselves from U.S. Pat. No. 2,796,034 (German Pat. No. 1 092 284) but generally they form part of a three-dimensional cross slide system and are located laterally of or below the bearing surface for the work holder.

SUMMARY OF THE INVENTION

The innovation provides a zig-zag stitch group sewing machine where the movement plane of the needle bar is oriented parallel to the longitudinal direction of the arm and the work holder is moved in a straight path directed crosswise to it, and in order to minimize the drive forces, the work holder has little inertia and is mounted with little friction.

According to the invention, by arranging the work holder for movement in a straight guide disposed in the region of the housing head at a small distance from the needle bar, a small moment occurs because of the small distance between the guide and the frictional engagement of the work holder on the stitch plate or on the support arm of the sewing machine and thus small tilting forces prevail within the guide. The new suspension of the work holder is therefore especially compact and low in friction, this having a favorable effect in particular for direct drive of the cam plate by a motor of its own. In addition, because of the short horizontal distance between the guide and the work holder, play within the guide can have little effect, so that a very precise transmission is achieved.

Since the work holder has only a driver plate gripping the work from above and is not designed like the conventional work clasps acting like pliers, a very substantial reduction of the mass to be moved is achieved by the elimination of the rigid clasp strap.

Accordingly, it is an object of the invention to provide an improved zig-zag stitch group sewing machine with a work holder which is received in a rectilinear guide and arranged in the region of the head of the machine at a small distance from the needle bar and which comprises a driver plate which grips the work from above.

A further object of the invention is to provide a zig-zag stitch group sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4 is a top plan view of the head area for the sewing machine of FIG. 1;

FIG. 5 is a top plan partial view of trousers whose belt loops can be sewn in accordance with the invention; and FIG. 6 is a view taken of the circled portion of FIG. 5, on an enlarged scale.

DESCRIPTION OF THE PREFERRED EMBODIMENT

Figure 1:
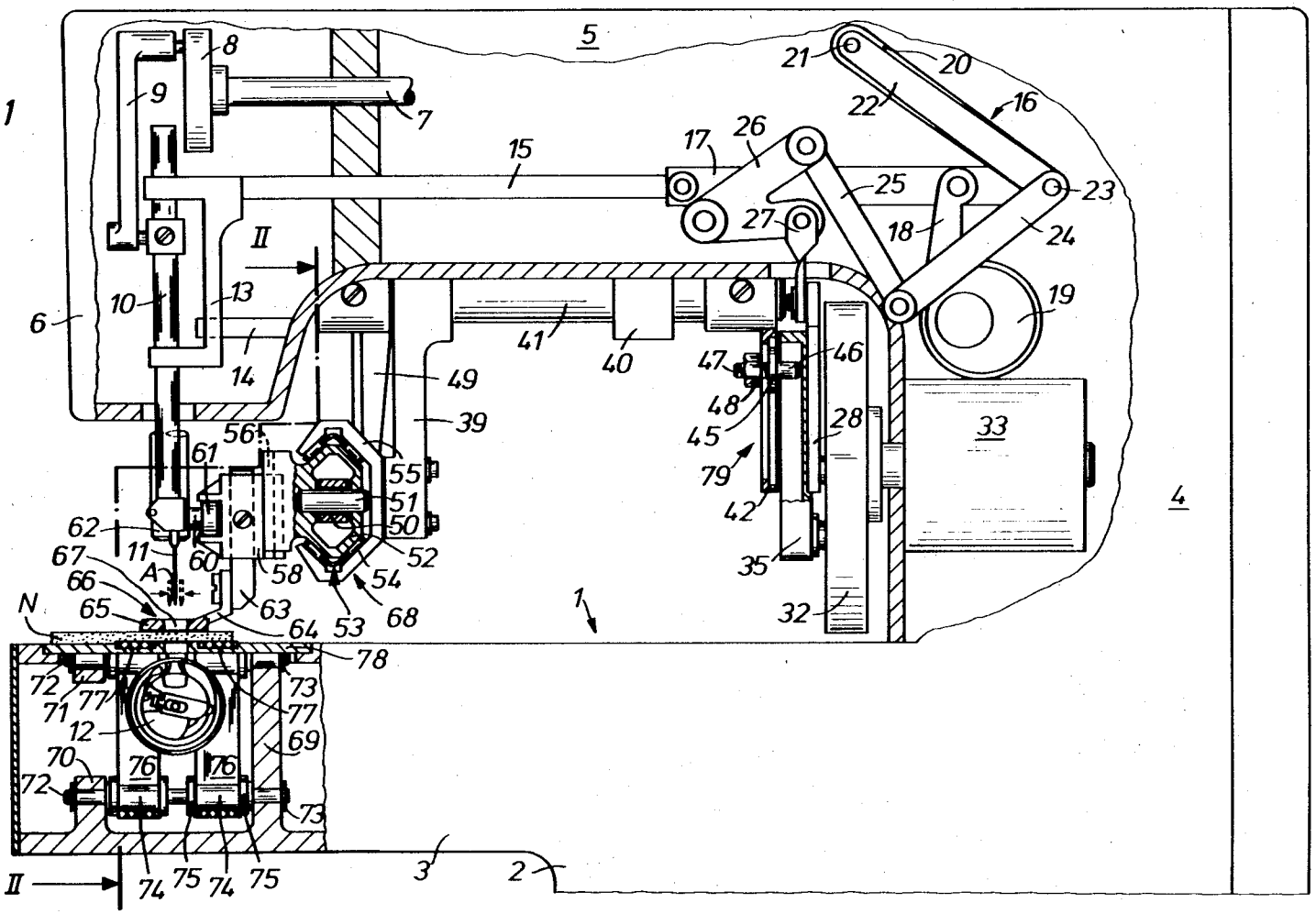
FIG. 1 shows a partial side elevational and sectional view of a stitch group sewing machine constructed in accordance with the invention.
Figure 3:
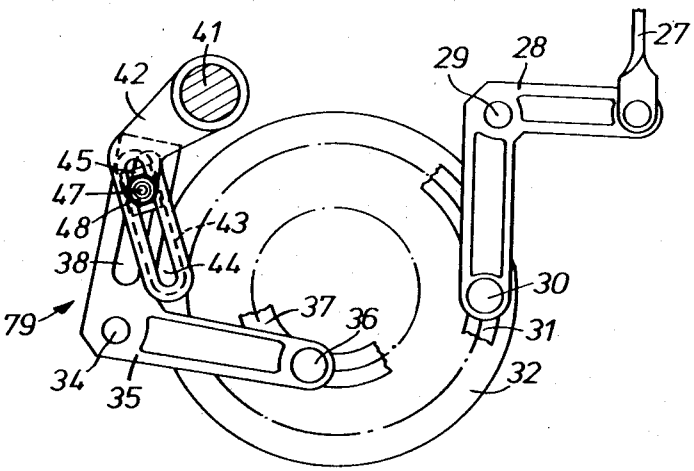
FIG. 3 is a side view of the cam plate and its sensing element.

Referring to the drawings in particular the invention embodied therein comprises a zig-zag stitch group sewing machine which has a housing generally designated 1 including a standard 4, an arm portion 5 extending in a longitudinal direction and terminating in a head portion 6 of a needle bar 10 which is mounted in the head portion for reciprocation and for swinging movement through an amplitude of movement designated A parallel to the longitudinal direction of the arm portion 5. In accordance with the invention, a work holder generally designated 68 is movable by a driven cam plate 32 and has a drive which is cross wise to the plane of the zig-zag motion of the needle bar 10. The work holder 68 is received in a rectilinear guide 55 arranged in the region of the head 6 and a small distance from the needle bar 10 and comprises a drive plate 66 which grips the workpiece N from above.

The sewing machine comprises a housing 1 which consists of a pedestal 2, a support arm 3, a standard 4, and an arm 5 which terminates in a head 6. Mounted in arm 5 is an arm shaft 7 which drives a needle bar 10 via a crank 8 and a link 9. Fastened in the needle bar 10 is a thread carrying needle 11 which for the formation stitches cooperates with a shuttle 12 in support arm 3.

The needle bar 10 is received in a frame driver 13 which is displaceably mounted on a stud 14 extending parallel to the longitudinal axis of arm 5. The connecting rod 15 constitutes the output elements of a zig-zag stitch setter 16 by which the swinging amplitude A of the needle 11 and hence the overstitch width of zig-zag stitches is controlled. The zig-zag stitch setter 16 is a known articulated stitch setter. It comprises a lever 17, one end of which is connected with the connecting rod 15.

Articulated to the lever 17 is an eccentric rod 18 which engages around an eccentric 19. The eccentric 19 is driven by the arm shaft 7 via a drive (not shown). The other end of lever 17 is connected with one end of a link 20. At the other end of the link 20 there engages, via a stud 21, a crank 22 which extends substantially parallel to the link 20 and which is fastened on a shaft 23. Shaft 23 carries a crank 24 which is connected via a link 25 with one arm of a two-arm crank 26. At the other arm of crank 26 a link 27 passing through the wall of arm 5 is articulated.

Link 27 is connected with an angle lever 28, which is mounted on a stud 29 fixed on the housing. The angle lever 28 engages by a sensing pin 30 into a groove 31 of a cam plate 32. Cam plate 32 is mounted on the standard 4 and is drive connection with a motor 33 of its own. Links 17 and 27 with lever 28 and rod 15 thus act as needle bar drive means for driving frame 13 of the needle bar 10 from cam plate 32.

An angle lever 35 mounted on a stud 34 fixed on the housing engages by a sensing pin 36 into another groove 37 in the cam plate 32. At its other leg the angle lever 35 has a slot 38.

In two projections 39, 40 of arm 5 a shaft 41 is mounted. At one end of shaft 41 a crank 42 is fastened, which has a slot 44. On the side toward the angle lever 35, slot 44 changes over into a recess 43. Disposed in recess 43 is a sliding block 45 which carries on one side a stud 46 engaging in the slot 38 of the angle lever 35 and on the other side a bolt 47 protruding through slot 44. The position of the sliding block 45 inside the recess 43 can be fixed by a nut 48 screwed onto bolt 47.

At the other end of shaft 41 a crank 49 is fastened, which is connected via a link 50 and stud 51 with a hollow slide 52. By means of a rolling bearing 53 consisting of four rows of pin type rolling elements 54, slide 52 is displaceably mounted in a guide 55 of C-shaped cross-section extending horizontally and crosswise to the longitudinal direction of arm 5 in a straight line. Guide 55 is fastened to the prolonged projection 39.

Slide 52 has a vertically extending guide groove 56, in which laterally protruding guide flanges 57 of a slide piece 58 are received. Engaging in a horizontally extending groove 59 of slide piece 58 is a roller 61 rotatably mounted on a stud 60. Stud 60 is fastened on a presser bar mounted in head 6. In slide piece 58 are adjustably fastened two carriers 63, on each of which a plate portion 64 is fixed. The horizontal sections 65 of the plate portions 64 are U shaped as seen in top view. Together the two plate portions 64 form a driver plate 66 gripping the work N from above, an oblong passage slot 67 for the needle 11 being formed in the driver plate 66 due to the U-shape of the sections 65. The width of the passage slot 67 is adapted to the maximum swinging amplitude A of needle 11.

Through a spring mechanism correlated with the presser bar 62 which is known and therefore not illustrated, a downwardly directed pressing force can be exerted via the presser rod 62 and roller 61 on the slide piece 58 and hence on the driver plate 66. Slide 52, sliding piece 58, the carriers 63, the driver plate 66 and the presser bar 62 with roller 61 form a work holder 68.

In a partition 69 and two lugs 70,71 of the support arm 3, four studs 72 extending parallel to the latter's longitudinal direction are arranged and retained axially by lock rings 73. On each of the studs 72 two guide rollers 74 are freely rotatable and have lateral flanges 75. On each of the correlated groups of four guide rollers 74 an endless belt 76 is arranged. The top strands of the belts 76 run in shallow recesses 77 of the stitch plate 78 disposed in the support arm 3. By suitable matching of the material of the belts 76 and stitch plate 78 and corresponding surface configuration, the frictional resistance between belts 76 and stitch plate 78 is reduced to a minimum. The spacing between the two belts 76 is adapted to the maximum swinging amplitude A of needle 11.

The machine operates as follows:

For insertion of the work N under the work holder 68, the slide piece 58 is moved upward by way of the presser bar 62 and roller 61 and thereby the drive plate 66 is lifted off the belts 76. After the work N has been placed on the belts 76, the slide piece 58 with the driver plate 66 is lowered again and it presses the work N against the belts 76.

Thereafter the sewing machine is turned on. With the sewing machine running, the cam plate 32 is driven by the motor 33.

A radial rise or fall of the cam groove 37 leads to a rotation of the angle lever 35. The rotation of the angle lever 35 is transmitted via stud 46 and sliding block 45 to crank 42, the transmission ratio of the work holder drive means 79 formed by angle lever 35 and crank 42 being determined by the radial distance of the slide block 45 with stud 46 relative to stud 34 or shaft 41.

The rotation of crank 42 is transmitted to slide 52 through shaft 41, crank 49 and link 50, whereby the slide is displaced inside the guide 55. The work holder 68 then carries out a rectilinear movement crosswise to the longitudinal direction of arm 5. As the belts 76 are dynamically coupled through the work N with the driver plate 66 pressing downward under a spring load, they participate in the movement of the work holder 68 and bring about no appreciable frictional resistances that are opposed to the movement of the work holder 68 or the work N.

Since lever 17 is connected with the end of link 20 opposite stud 21, the swinging movement caused by the eccentric 19 at lever 17 when the sewing machine is running brings about at the same time also a swinging movement of link 20. If link 20 occupies a swivel position differing from the position of lever 17, the swinging movement of link 20 at the hinge point with lever 17 has a horizontal component, which causes the lever 17, and hence the connecting rod 15 and needle bar 10 to execute lateral swinging movements in the rhythm of stitch formation.

In the relative position of link 20 relative to lever 17 as illustrated in the drawing, the stitch setter 16 is set to maximum swinging amplitude A of needle 11, so that zig-zag stitches of greatest overstitch width are sewn.

The adjustment of stitch setter 16 is controlled by cam plate 32, in that the cam groove 31 determines the radial distance of the sensing pin 30 from the axis of rotation of cam plate 32. The position of sensing pin 30 in turn determines, via angle lever 28, link 27, crank 26, link 25, crank 24 and crank 22, the relative position of link 20 relative to lever 17 and hence the swinging amplitude of needle 11.

Figure 2:
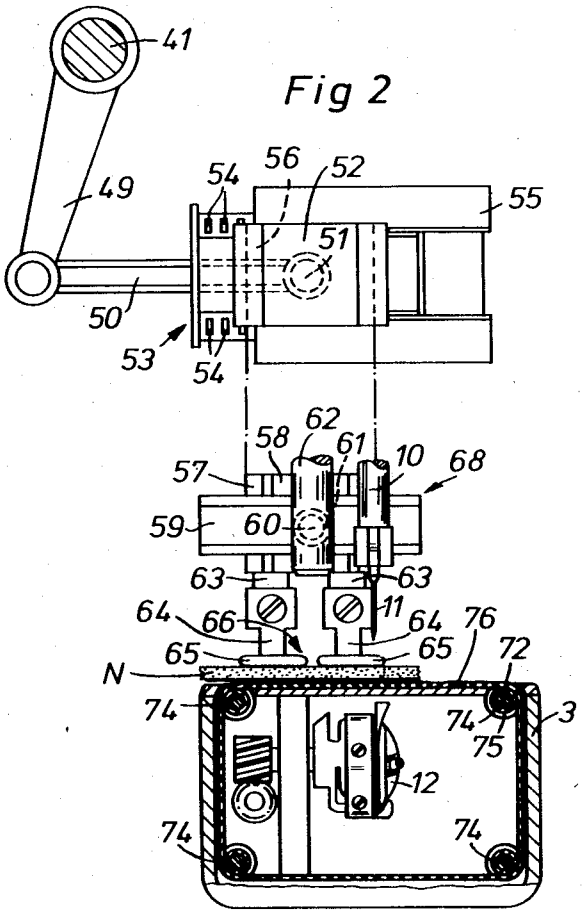
FIG. 2 is a sectional view of a part of the sewing machine along line II—II of FIG. 1, the guide of the work holder and its pressure plate being represented separately for greater clarity.

For the sewing machine, shown in a simplified fashion in FIG. 4, the plane of oscillation of the needle bar 10, which runs parallel to the longitudinal direction of the arm 5, is indicated by the double arrow S. Furthermore, the path of motion of the holder 68 for the material to be sewn, which was shown in FIGS. 1 and 2 and which runs transversely to this direction, is indicated by the arrow K.

Frequently, to accommodate a belt, several belt loops G are sewn on at the waistband B of trousers H with the help of two bar tacks R as shown in FIGS. 5 and 6. The bar tacks R comprise a large number of zigzag stitches Z. In order to carry out a sewing process, the trousers H, with the catch plate 66 raised (FIGS. 1 and 2), are placed on the driving belts 76 and the catch plate 66 is subsequently lowered once again. After the sewing machine is switched on, the zigzag stitches Z are formed by the timewise superimposition of the oscillatory motion of the needle bar 10 in the direction of arrow S and the continuous forward-feed motion of the holder 68 for the material to be sewn, the forward-feed motion of the holder 68 for the material to be sewn taking place in one of the two arrow directions of the double arrow K.

While a specific embodiment of the invention has been shown and described in detail to illustrate the application of the principles of the invention, it will be understood that the invention may be embodied otherwise without departing from such principles.

What is claimed is:

1. In a zig-zag stitch group sewing machine having a housing with a base portion, a standard portion extending upwardly from the base portion, an arm portion extending in a longitudinal direction outwardly from an upper portion of the standard portion, a head portion at the end of said arm portion, a needle bar mounted in said head portion for upward and downward reciprocating motion, the improvement comprising a driver movably mounted to said housing and engaged with said needle bar for moving said needle bar in a direction parallel to said longitudinal direction of said arm portion for swinging said needle bar in said longitudinal direction, a work holder mounted to said housing near said needle bar for holding and moving a workpiece on said base portion, a cam plate mounted for rotation to said housing, cam plate drive means connected to said cam plate for rotating said cam plate, needle bar drive means operatively connected between said cam plate and said driver for moving said needle bar parallel to said longitudinal direction, work holder drive means operatively connected between said cam plate and said work holder for driving said work holder transversely to said longitudinal direction, a rectilinear guide arranged on said housing adjacent said head portion at a closely spaced location from said needle bar and engaged with said work holder for guiding said work holder for rectilinear motion transversely to said longitudinal direction, said work holder including a driver plate extending below said head portion and gripping the workpiece on said base portion from above.

2. In a zig-zag stitch group sewing machine according to claim 1, wherein said cam plate is arranged in the vicinity of said standard portion and includes a groove, said work holder drive means comprising a sensing element engaged in said groove, an adjustable lever drive connected to said sensing element, a shaft connected to said lever drive extending along said arm portion, a crank connected to said shaft and pivotal thereby and a link with a slide carrying said work holder connected to said crank for sliding in said guide.

3. In a zig-zag stitch group sewing machine according to claim 1, including a seating for the workpiece movable parallel to said guide and operable in a dynamic coupling with said driver plate.

4. In a zig-zag stitch group sewing machine according to claim 3, wherein said seating comprises two spaced apart endless belts located in said base portion and roller means supporting said belts in said base portion below the workpiece and said driver plate spacing said rollers apart in a manner corresponding to the maximum amplitude of the needle swinging motion.

5. In a zig-zag stitch group sewing machine having a housing with a base portion, a standard portion extending upwardly from the base portion, an arm portion extending outwardly from an upper portion of the standard portion, a head portion at the end of said arm portion, a needle bar mounted in said head portion for upward and downward swinging motion, the improvement comprising a rotatable cam plate, a work holder engaged with said cam plate and movable thereby, a rectilinear guide arranged adjacent the head portion at a spaced location from said needle bar and engaged with said work holder for guiding said work holder rectilinearly, said work holder including a driver plate extending below said head portion and gripping a workpiece on said base portion from above, a seating for the workpiece movable parallel to said guide and operable in a dynamic coupling with said driver plate, said seating comprising two spaced apart endless belts located in said base portion and roller means supporting said belts in said base portion below the workpiece and said driver plate spacing said rollers apart in a manner corresponding to the maximum amplitude of the needle for swinging motion.

* * * * *